US007841959B2

(12) United States Patent
Bremner

(10) Patent No.: US 7,841,959 B2
(45) Date of Patent: Nov. 30, 2010

(54) LOOP STICK

(76) Inventor: Ronald Bremner, 801 Ritson Road South, Oshawa, ON (CA) L1H 5L3

( * ) Notice: Subject to any disclaimer, the term of this patent is extended or adjusted under 35 U.S.C. 154(b) by 39 days.

(21) Appl. No.: 12/302,858

(22) PCT Filed: May 29, 2007

(86) PCT No.: PCT/CA2007/000940

§ 371 (c)(1),
(2), (4) Date: Nov. 28, 2008

(87) PCT Pub. No.: WO2007/137416

PCT Pub. Date: Dec. 6, 2007

(65) Prior Publication Data

US 2009/0253537 A1 Oct. 8, 2009

(30) Foreign Application Priority Data

May 30, 2006 (CA) ..... 2548848

(51) Int. Cl.
*A63B 59/14* (2006.01)

(52) U.S. Cl. ..... 473/563; 473/446

(58) Field of Classification Search ..... 473/446, 473/471, 560–563
See application file for complete search history.

(56) References Cited

U.S. PATENT DOCUMENTS

| | | | | |
|---|---|---|---|---|
| 682,807 | A | 9/1901 | Minor | |
| 907,571 | A | 12/1908 | Chesebro | |
| 2,072,682 | A | 3/1937 | Morgan | |
| 3,809,401 | A | 5/1974 | Hankele | |
| 3,844,555 | A * | 10/1974 | Tremblay | 473/563 |
| 4,491,320 | A | 1/1985 | Smith | |
| 5,672,129 | A | 9/1997 | Rudell | |
| 5,688,197 | A * | 11/1997 | Peeters et al. | 473/446 |
| 6,716,120 | B1 * | 4/2004 | Normand | 473/446 |
| 6,743,126 | B2 * | 6/2004 | Murphy et al. | 473/563 |
| 2004/0097306 | A1 | 5/2004 | Dehen | |
| 2008/0039240 | A1 * | 2/2008 | Normand | 473/425 |
| 2009/0264229 | A1 * | 10/2009 | Forsberg | 473/563 |
| 2009/0291779 | A1 * | 11/2009 | Wilton | 473/425 |

FOREIGN PATENT DOCUMENTS

| | | |
|---|---|---|
| CA | 967606 | 5/1975 |

* cited by examiner

*Primary Examiner*—Mark S Graham
(74) *Attorney, Agent, or Firm*—Lang Michener LLP

(57) ABSTRACT

The invention consists of a blade for a hockey stick, comprising: a blade portion, with a forehand side and a backhand side and a loop extending from the one or both sides of the blade portion, with the loop dimensioned to enclose a hockey puck.

16 Claims, 5 Drawing Sheets

LOOP STICK

FIELD OF THE INVENTION

The present invention relates to the field of hockey sticks and the sport of hockey. In particular, it relates to a modified hockey stick and blade for use in training hockey skills.

BACKGROUND OF THE INVENTION

Hockey (often called "Ice Hockey") is a fast-paced, physical sport in which many children and adults participate, particularly in North America and Europe. Historically, hockey has been a primarily male sport; however, the recent creation of the Women's World Hockey Championship, as well as the addition of Women's Hockey as an Olympic event has vastly increased the number of female players in the last decade. As a result, there are now more players, of both sexes, picking up the sport for the first time than at any previous time in history.

One of the primary attributes of a good hockey player is the ability to make good split-second choices about where and when to shoot, pass and carry the puck. In order to make these choices, the player needs to be aware of the location, speed, and direction of travel of the other players on the ice ("seeing the ice"). In order to see the ice properly, the player needs to be able to control the puck with their stick while keeping their head (eyes) up, not looking at their stick and the puck.

This skill of controlling the puck without looking at it is very difficult to learn and master, particularly for younger children who are still developing their basic motor skills. At the same time, it is a skill that must be developed in order to successful play hockey at more competitive levels and gain the most enjoyment from participating in the sport. A complicating factor in developing the skill is that the players are constantly in motion and the skill needs to be developed in conjunction with developing skating ability. In other words, it is still insufficient to be able to control the puck without looking if it cannot also be done while skating.

Another concern is player safety. A player who is looking down at the puck and not seeing the ice is more vulnerable to having a collision, whether as an intentional body check from another player or merely through inadvertent contact. Additionally, as the player is not prepared for the collision, the severity of the collision and risk of injury as a result is substantially increased. Parenthetically, it is noted that even professional players are vulnerable in this fashion, either through not having fully developed the skill or simply being engaged in a play where it is required to look down at the puck (e.g. when a loose puck is caught up in the players skates). Thus, the safety of the player with proper puck-handling skill is protected by minimizing risk, not eliminating it.

To address this safety concern, the Heads Up Hockey program, conceived in the early-90's by Dr. Alan Ashare, the chairman of USA Hockey's safety and protective equipment committee, emphasizes what players can do to play safer, smarter and better hockey: "The first—and perhaps the most important—rule of Heads Up Hockey is, "Heads up, don't duck!". Whenever you see potential impact coming your way, whether it is another player, the boards or the goal post, you should never duck your head. When your head is ducked down, the head and neck are much more vulnerable to injury. When your head is up, the neck is given maximum flexibility to endure impact without injury, because the natural curve of the neck is not compromised. When your head is down, the spine's normal curve is straightened, and any impact can cause injury."

Balanced against the need to learn heads-up skills is the extrinsic admonition to players and the intrinsic motivation not to lose control of the puck. With this concern in mind, most players, if not all, learn to stickhandle and control the puck by looking down and watching it while performing various training exercises and practice drills. The players' fear over losing control of the puck creates a compulsion to, if not continually look down, at least regularly look down to confirm that control of the puck is maintained.

This compulsion results in a learning process where players first learn to stickhandle and control the puck while looking down at it, and then learn to maintain control with their head up. The transition is generally difficult, particularly for younger players. Additionally, because the players have never discovered or experienced the benefits of seeing the ice, they lack the motivation and perseverance to become fully comfortable or capable of playing without looking down at the puck. Players can become frustrated with a lack of progress and stop participating in hockey at an earlier age than if they had developed the proper head up, seeing the ice skills from the start.

Instruction in this manner tends to limit the development and participation of all but those players who can most readily adapt to this process. By analogy, consider if the preferred manner of learning to drive an automobile was to focus on the placement and use of the steering wheel, pedals and gearshift before looking up through the windshield. If driving was taught in such a fashion, most learner drivers, intent on controlling the instruments per se, would take much longer to develop the perceptual skills needed to navigate safely past pedestrians and vehicles on streets and highways. Similarly, hockey players who play with their heads down in order to focus on the stick and puck, either never adequately learn or take much longer to learn to navigate safely and effectively past other players and obstacles, due to being unable to watch the game in front of them.

A related requirement is for the player to keep their stick on the ice surface as much as possible, both with and without the puck. Players who develop the habit of keeping their stick on the ice at all times also stay in a proper 'ready' posture for receiving passes and reacting to plays. Players without this habit tend to straighten up their body during play without the puck, pulling their stick off the ice surface and delaying their ability to react to passes and loose pucks. Also, players who have straightened up are less able to absorb incidental body contact or body checks. By developing proper heads-up puck control skills, players will also keep themselves in proper posture, leading to improved play as well as improved safety.

A sport functionally identical to hockey, sledge hockey, has been developed for people with disabilities and has been included in the ParaOlympic games. A sledge hockey stick is similar to a conventional hockey stick, with a shorter shaft (as the player is positioned closer to the ice surface) and a pick on the end of the shaft the player can use to propel themselves along the ice surface. Maintaining control of the puck is difficult for sledge hockey players, even more so than in conventional hockey. Ideally, any training aid developed for use by hockey players should also be quickly and easily adapted for use in sledge hockey, in order to enable more participation and more rewarding involvement in that sport.

Also notable is that in sports similar to hockey where control of the puck or ball is aided by the equipment, with lacrosse and ringette as common examples, players exhibit team play skills at an earlier age as there is no development time lost to learning ball or puck control skills, nor is there a skill learning impediment created by the need to do so.

Several types of training aids for stickhandling and puck control are known in the art. One type is exemplified in U.S. Pat. No. 3,863,917 to Beale and U.S. Pat. No. 6,716,120 to Normand. Both Beale and Normand disclose modified hockey sticks and puck which use a tether to connect the puck to the blade of the stick. The presence of the tether allows the player to readily retrieve a puck which has been lost from a failure to properly control it during stickhandling. However, neither Beale nor Normand permit for participation and use by more than one player for passing, checking and shooting drills, or playing hockey. The tether limits the usefulness of the Beale and Normand sticks to single-player stickhandling only.

An additional limitation of tether-type device as disclosed by Beale and Normand is the need for a modified or customized puck for use with the tether. Ideally, a training aid should be functional with a standard puck (or ball, for dry land training and ball-based versions of hockey).

Another type of training aid is disclosed in U.S. Pat. No. 4,653,753 to Scarry and U.S. Pat. No. 6,174,248 to Lawlor et al. Scarry and Lawlor both disclose variants of shields that are attached to a hockey stick at a location above the blade. The shield prevents the player from seeing the blade of the stick and the puck when it is in the vicinity of the blade. While the shield devices of Scarry and Lawlor may act to discourage players from looking down to confirm control of the puck, they do not provide any actual assistance to the player in maintaining control. Furthermore, it is not necessarily desirable that the player have no ability to look down and see the puck and stick blade. In passing and shooting situations, a quick look down to confirm the location of the puck is not wholly undesirable.

There is a need for a hockey stick training device, which removes the learning impediment caused by players keeping their heads down in order to control the puck. By facilitating control of the puck, the hockey stick training device allows players to discover and experience the predominant benefits of seeing the ice vis à vis controlling the puck. The device should provide a means for preventing the player from losing control of the puck. The same device should also allow the stick to function in a conventional manner to permit its use in multiple player drills and game situations.

SUMMARY OF THE INVENTION

The invention consists of a blade for a hockey stick, comprising: a blade portion, with a forehand side and a backhand side and a loop extending from either the forehand side or the backhand side, with the loop dimensioned to enclose a hockey puck. Alternatively, the blade may have two loops, one located on each side of the blade.

The loop can be secured to the blade portion by passing ends of the loop through the blade portion or, alternatively, by passing ends of the loop over the blade portion.

The loop can further include a cover surface to enclose the hockey puck and prevent the hockey puck from being projected out of the loop. The cover may enclose the entire loop.

The loop can be formed from a rigid material or from a flexible material.

Alternatively, the loop can be secured to the blade via a mechanism which permits the loop to be repositioned between the forehand and the backhand side of the blade. Optionally, the mechanism can permit the loop to additionally be positioned in a neutral position above the blade.

Preferably, the mechanism can be triggered by a player through creating forceable contact between the loop and a playing surface.

An alternative to a complete loop is a partial loop formed from two pieces, with the separation of the pieces, which provide the enclosure, being less than the dimension of the hockey puck.

The invention further consists of a hockey stick incorporating the blade and loop as previously described.

Other and further advantages and features of the invention will be apparent to those skilled in the art from the following detailed description thereof, taken in conjunction with the accompanying drawings.

BRIEF DESCRIPTION OF THE DRAWINGS

The invention will now be described in more detail, by way of example only, with reference to the accompanying drawings, in which like numbers refer to like elements, wherein.

DETAILED DESCRIPTION OF THE PREFERRED EMBODIMENTS

Within this specification, "puck" is used to described a standard ice hockey puck, as well other similar objects used for playing and practicing hockey, such as plastic pucks, rollers pucks (used in roller hockey) and hockey balls (used in floor hockey and dry land practicing).

Figure 1:
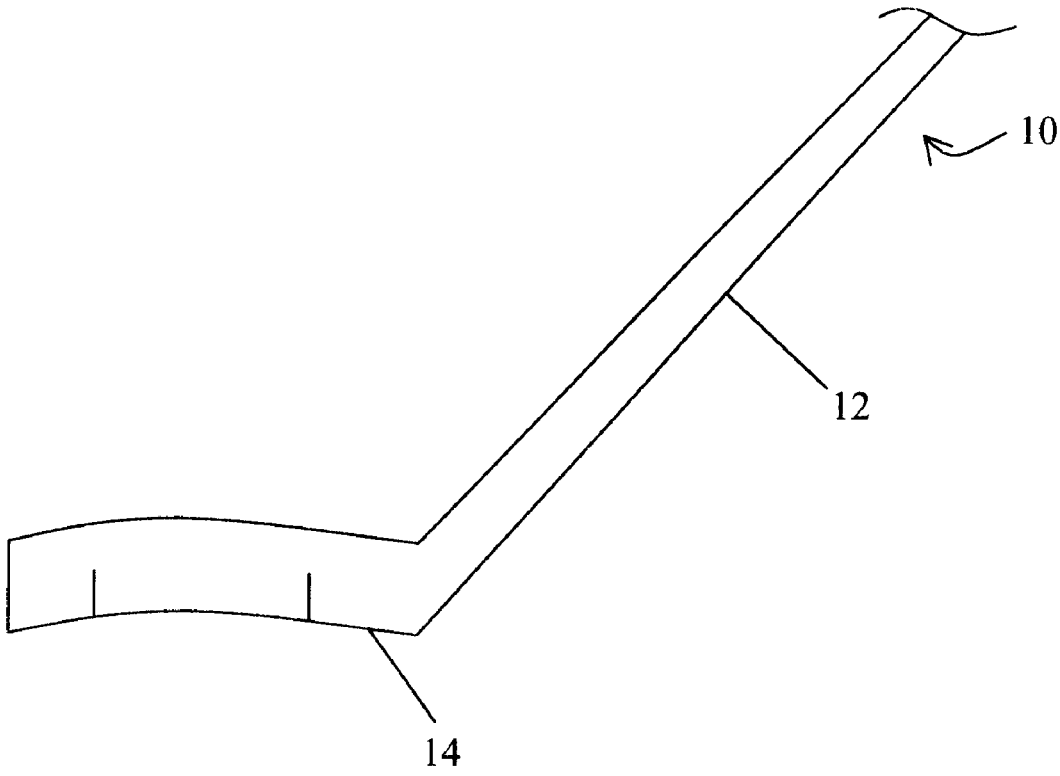
FIG. 1 is a front view of a hockey stick according to the present invention.
Figure 2:
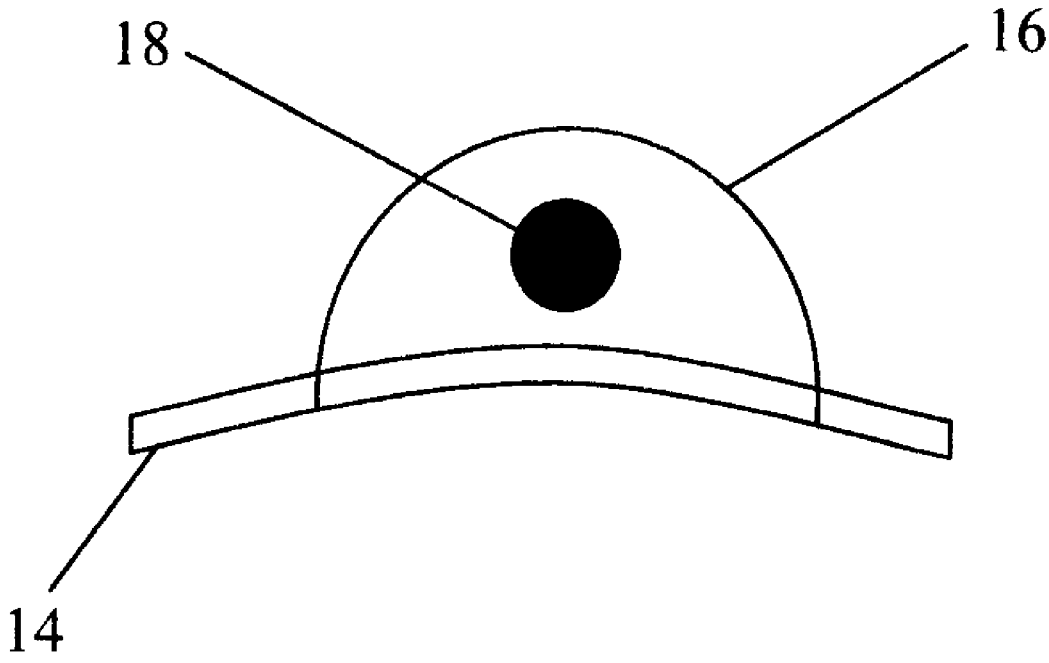
FIG. 2 is a top view of the blade portion of the hockey stick of FIG. 1.
Figure 3:
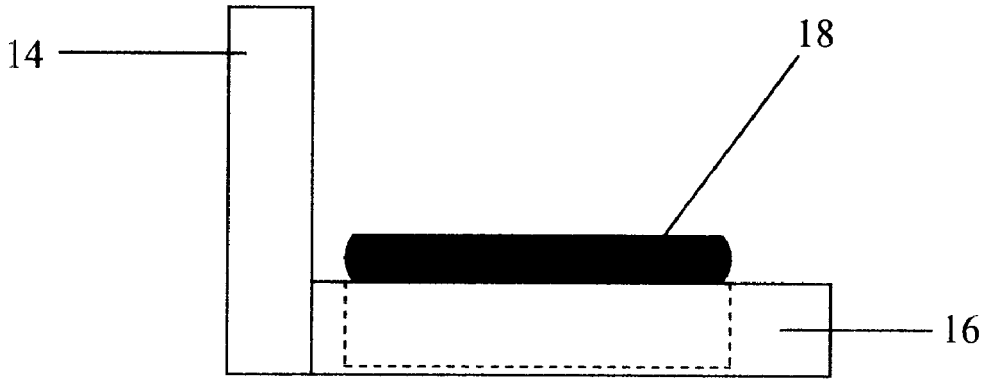
FIG. 3 is a side view of the blade portion of the hockey stick of FIG. 1.

Referring to FIG. 1, there is shown a loop hockey stick 10, with a shaft 12 and a blade 14, with a preferred embodiment of the present invention as shown in FIGS. 2 and 3 consisting of a loop 16 of material which is coupled to the blade 14. The loop 16 is of sufficient size to fully enclose a standard hockey puck 18 and acts to trap the puck 18 against the backhand (convex curve) side of the blade 14. The blade 14 is shown curved for clarity in the drawing and description, however, the loop 16 can be equally used with a straight blade 14. In order to keep the weight of the hockey stick 10 to a minimum, the loop 16 need not be a solid piece of material, but can have holes cut into it or even be a mesh, as long as the shape of the loop 16 can be generally maintained. The puck 18 is readily removed from the loop 16 by raising the blade 14 off the ice (playing surface) and transitioning the puck 18 to the forehand (concave curve) side of the blade 14 in a standard stickhandling motion.

Figure 4:
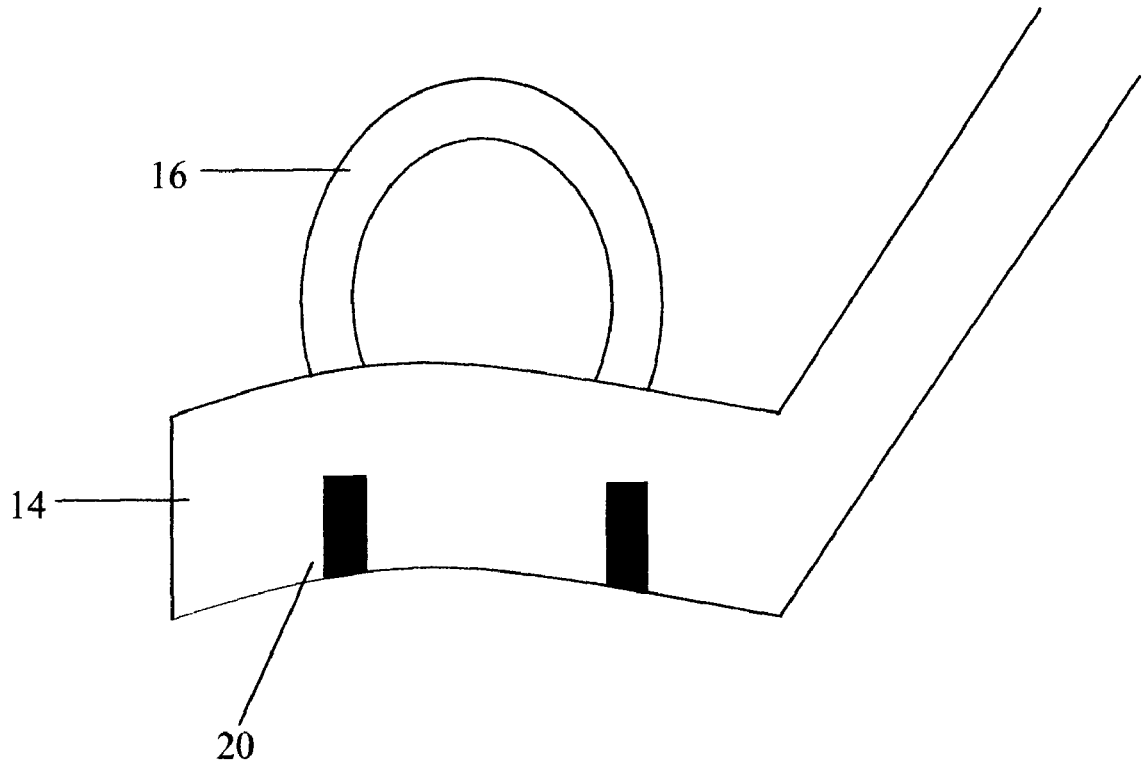
FIG. 4 is a front close-up view of the blade portion of the hockey stick of FIG. 1; and, FIG. 5 is a front close-up view of the blade portion of a hockey stick according to an alternative embodiment of the present invention.

The loop 16 can be attached to the blade 14 in either a permanent or temporary fashion. A permanent attachment is shown in FIG. 4, where the loop 16 is attached by securing the ends of the loop 16 through slots 20 in the blade 14. Alternatively, the loop 16 can be formed as an integral part of the blade 14, made out of the same material as the blade 14 (wood or composites) or of a different material. A variety of different methods of affixing the loop 16 to the blade 14 can be contemplated, non-exhaustively including tape (hockey, duct, industrial), contact cement, Velcro™, staples, bolts, rubber or elastic bands that slip over the blade, or a special sleeve that fits over the blade and has two slits at the back. In all cases conventional hockey stick tape can be used to further secure the loop 16 as part of the normal application and usage of stick tape. It is considered preferable that the loop 16 be attached so the opposite surface of the blade 14 is not altered, e.g. for a loop 16 attached on the backhand side of the blade 14, there should be no protrusions or other alterations on the forehand side of the blade 14.

Figure 5:
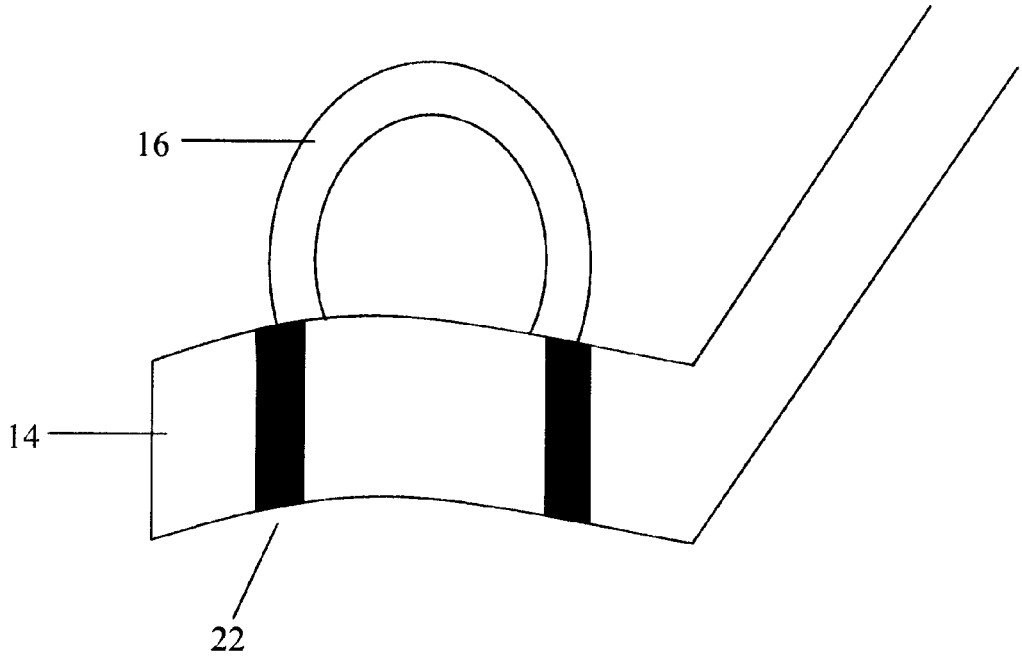

One type of attachment is shown in FIG. 5, where the ends of the loop 16 consist of slip loops 22 which are passed over the blade 14 and secured in place by tightening the slip loops 22. For additional security, the slip loops 22 can be taped over with conventional hockey stick tape to prevent slippage during use. A benefit of temporary attachment is that players can quickly adapt their regular sticks for use in practice and restore them to their original condition for a game. Also, in game situations, a damaged loop 16 can be replaced without the need to replace the blade 14, and vice-versa, where an undamaged loop 16 can be attached to a new blade 14.

Other variations of the loop 16 include a sleeve which fits over the entire blade 14, covering the front and rear faces. The sleeve can be stretchable to secure itself to the blade 14, or held in place with hockey tape. A tight-fitting sleeve is preferred to minimize interference with the feel and control of the puck 18 on the surface of the blade 14.

By positioning the loop 16 on the backhand side of the blade 14, the player can use the forehand side of the blade 14 to execute normal passing and shooting plays. Furthermore, a backhand shot or pass can be executed by tilting the angle of the blade 14 sufficiently to allow the puck 18 to slide under the loop 16. This can be made easier by positioning the loop 16 such that it is not in contact with the whole puck 18, but only the top half or third, which is still sufficient in most cases to keep the puck 18 trapped in the loop 16.

While the loop 16 is preferably contemplated as having its bottom surface flush with the bottom surface of the blade 14, alternative positions and shapes can be readily used to meet the same functional purposes. For example, the loop 16 can be secured to the blade 14 near the middle or top, and be positioned at an angle to be flush with the playing surface at the outer edge of the loop 16. Alternatively, the loop 16 can be tapered, being thinner near the blade 14, to allow for some angular tilt of the blade 14, and thicker near the outer edge of the loop 16, to provide containment for the puck 18.

In alternative embodiments, the loop 16 could be placed on the forehand side of the blade 14 or there can be a loop 16 located on both the forehand and backhand sides of the blade 14, for use in different drills and skill training exercises.

As another alternative, the loop 16 can be hinged so that it can be repositioned to the top of the blade 14, enabling the loop 16 to be moved from the forehand side to the backhand side or even to a neutral position above the blade. The hinges can be spring-loaded to lock the loop 16 into position once moved. The spring-loaded hinges can further be designed to trigger under pressure to allow the loop 16 to be repositioned during play. For example, with the loop 16 attached on the forehand side of the blade 14, it may interfere with attempts to make a forehand shot, as the shot motion involves cupping (tilting) the blade 14 towards the ice surface. A pressure-sensitive spring-loaded hinge can be used so that the cupping motion triggers the hinge and causes the loop 16 to spring into a neutral position over the blade 14, clearing the path for the shot. Alternatively, triggering the hinge may merely raise the loop 16 to a position sufficient to provide clearance for the puck 18, such as a 45-degree angle from the playing surface.

The loop 16 can be made from a rigid material (hard plastic, laminated wood, fibreglass) or a flexible material (nylon, soft plastic, polyethylene) as desired. A rigid loop 16 provide a more secure enclosure, but is vulnerable to fracture or breakage from contact with another stick. A flexible loop 16 is less likely to be broken, but provides a less secure enclosure. Either type of loop 16 is suitable for use, although particular drills or games can require one type of loop preferentially over the other. A flexible loop 16 is preferred, as in order to provide for proper shooting of the puck the stick blade 14 must be tilted and the loop 16 needs to flex in response to the tilting motion. When a rigid loop 16 is used, the attachment point of the loop 16 to the blade 14 provides the flexibility instead.

Alternatively, the loop 16 can be enclosed with a solid or mesh netting cover 20, which prevents the puck from inadvertently being bounced or knocked out of the loop 16. The cover 20 is particularly preferable for use with balls, which have less contact surface with the ground and are subject to more bouncing than pucks. Rather than a complete enclosure, the loop 16 may instead have a partial covering extended over a fraction of the surface or from specific regions of the loop. In particular, a loop 16 with an edge or lip along the top edge at the outermost section of the loop 16 provides most of the benefits of a full enclosure, while keeping the weight and material require for the loop 16 to a minimum.

The dimensions and shape of the loop 16 can be tailored for different purposes, the most significant of which is the difference between carrying the puck on the forehand side of the blade 14 and the backhand side of the blade 14. On the forehand side, the puck 18 is being pushed by the blade 14 and is partially contained by the curvature of the blade 14. By contrast, on the backhand side of the blade 14 the curvature of the blade 14 does not provide any assistance in containing the puck 18. Thus, a loop 16 located on the forehand side of the blade 14 can be effective in a smaller size than a loop 16 located on the backhand side as the containment requirements for the forehand loop are less demanding.

Additionally, the parameters of the loop 16 are governed by the same parameters used for the blade 14. Hockey stick blades are defined by several characteristics. First is the lie, which reflects the angle formed between the blade 14 and the shaft of the stick. Typical values for the lie range from 2 to 8, with higher numbers representing angles closer to 90 degrees. The next factor is the location of the curve of the stick, defined in one of three locations, heel (near the shaft), mid (center of blade) and toe (end of blade). Related to the location of the curve is the depth of the blade 14, as determined relative to a flat blade.

Two other blade measurements are commonly used. An open blade is tilted upwards (bottom forward, top back) relative to a flat blade, whereas a closed blade is tilted downwards (top forward, bottom back). Lastly, rockering is a term used to describe a blade which has a curved contact surface, as opposed to a flat contact surface, allowing the blade to maintain contact while moving into and away from the player's body.

In the preferred use of the loop 16, a non-rockered blade is used, with a closed face and a mid-curve of shallow depth. A higher lie (6 or 7) is preferred for beginners, as the blade 14 (and puck 20) is kept closer to the body, allowing for easier control.

Other blade modifications can be made to accommodate the loop 16. For example, a longer blade 14 provides for a larger loop 16, making the puck 20 easier to locate and handle within the loop 16.

Another variant of the loop 16 is a partial loop, where the loop is split into two separate pieces coupled to the blade 14 and the separation between the pieces is small enough to prohibit the puck from escaping the resulting partial loop. The partial loop has the advantage of being lighter than a full loop, as well as enabling a larger range of motion for the blade, while still providing an enclosure for the puck 18.

Using the loop stick 10, a player can develop puck carrying, passing and team-play skills without needing to look down for fear of losing the puck. The effect is that the learning curve for these basic hockey skills is advanced and reduced, increasing the novice player's enjoyment of the sport. Additionally, the player develops into a more complete player who is better able to coordinate with other players, and is potentially even capable of achieving a higher overall skill level than would otherwise be possible.

Fundamentally, by using the loop stick 10, a player is taught to give up their pre-occupation with control of the puck to gain control of the game. By eliminating concerns, which are often raised to an excessive level, over controlling and losing control of the puck, a player can watch and focus on the game as a whole. Through observing the movement and position of the other players, the individual player gains control over the whole game. The trade-off leads to players who have a higher skill level, are able to get the most from their physical talents, and who enjoy the game to their fullest potential.

This concludes the description of a presently preferred embodiment of the invention. The foregoing description has been presented for the purpose of illustration and is not intended to be exhaustive or to limit the invention to the precise form disclosed. Many modifications and variations are possible in light of the above teaching and will be apparent to those skilled in the art. It is intended the scope of the invention be limited not by this description but by the claims that follow.

What is claimed is:

1. A blade for a hockey stick, comprising:

a) a blade portion, with a forehand side and a backhand side; and b) a loop extending from one of said backhand side and said forehand side of said blade portion, said loop being flexible relative to said blade such that said loop is at least partially in contact with a playing surface both when said blade portion is perpendicular to the playing surface and when said blade is tilted up to 30 degrees from perpendicular to the playing surface in the direction of the side opposite to said loop, said loop being dimensioned to fully enclose a hockey puck when in contact with the playing surface, wherein said loop is formed with a blade-shaped portion which is secured to one of said forehand side and said backhand side of said blade portion by an adhesive.

2. The blade of claim 1, wherein the loop extends from the backhand side and the loop remains in contact with the playing surface when said blade is tilted up to 30 degrees from perpendicular to the playing surface in the direction of the forehand side through up to 30 degrees from perpendicular to the playing surface in the direction of the backhand side.

3. The blade of claim 1, wherein said loop further includes a cover surface to enclose said hockey puck and prevent said hockey puck from being projected out of said loop.

4. The blade of claim 3, wherein said cover surface fully covers said loop.

5. The blade of claim 1, wherein said loop is formed from a flexible material.

6. The blade of claim 5, wherein the flexible material is a thermoset elastomer.

7. The blade of claim 5, wherein the flexible material is a thermoset polymer.

8. The blade of claim 1, further including a second loop such that said blade has a loop extending from both of said forehand side and said backhand side.

9. A hockey stick incorporating the blade of any one of claims 1, 2, 3, 4 and 5-8.

10. A method of playing hockey, comprising:

a) providing one or more players with a hockey stick according to claim 9; and b) engaging in one or more hockey activities incorporating said hockey stick.

11. A loop for attachment to a hockey stick blade, said hockey stick blade having a forehand side and a backhand side comprising:

a) a blade-shaped portion which is secured to one of said forehand side and said backhand side of said hockey stick blade by an adhesive; and, b) a loop portion extending from said blade-shaped portion, said loop portion being flexible relative to said hockey stick blade and at least partially in contact with a playing surface when said hockey stick blade is perpendicular to the playing surface and said loop portion dimensioned to fully enclose a hockey puck when in contact with the playing surface.

12. The loop of claim 11, wherein the loop portion remains in contact within the playing surface when said hockey stick blade is tilted up to 30 degrees from perpendicular to the playing surface in the direction of the forehand side.

13. The loop of claim 11, wherein said blade-shaped portion is shaped to permit attachment to either said forehand side or said backhand side of said hockey stick blade.

14. The loop of claim 11, wherein said loop portion is formed from a thermoset elastomer.

15. The loop of claim 11, wherein said loop portion is formed from a thermoplastic elastomer.

16. The loop of claim 11, wherein said loop portion further includes cutout regions to reduce weight.

* * * * *